US005111009A

United States Patent [19]

Chan et al.

[11] Patent Number: 5,111,009

[45] Date of Patent: May 5, 1992

[54] OPERATING MECHANISM FOR THROWING TOGGLE SWITCHES

[75] Inventors: Anthony W. P. Chan, Willowdale; Richard M. Phillips, Whitby, both of Canada

[73] Assignee: Cooper Industries, Inc., Houston, Tex.

[21] Appl. No.: 612,467

[22] Filed: Nov. 14, 1990

[51] Int. Cl.[5] ..... H01H 9/20

[52] U.S. Cl. ..... 200/330; 200/336; 200/337; 200/338; 200/50 A

[58] Field of Search ..... 200/330, 331, 332, 336, 200/337, 338, 50 C, 50 A

[56] References Cited

U.S. PATENT DOCUMENTS

| | | | |
|---|---|---|---|
| 2,213,657 | 9/1940 | Rowe | 200/330 |
| 2,237,570 | 4/1941 | Olley | 200/330 |
| 3,069,518 | 12/1962 | Soos | 200/50 C X |
| 3,158,701 | 11/1964 | Nad et al. | 200/50 C |
| 3,369,100 | 2/1968 | Kussy et al. | 200/330 |
| 3,609,261 | 9/1971 | Rys | 200/50 A |
| 3,735,664 | 5/1973 | Clement | 200/50 A |
| 3,970,808 | 7/1976 | Gryctko et al. | 200/50 A |
| 4,612,424 | 9/1986 | Clark et al. | 200/50 A |

FOREIGN PATENT DOCUMENTS

| | | | |
|---|---|---|---|
| 0106912 | 6/1917 | United Kingdom | 200/331 |
| 0107493 | 7/1971 | United Kingdom | 200/331 |

*Primary Examiner*—Ernest G. Cusick

*Attorney, Agent, or Firm*—Blake, Cassels & Graydon

[57] ABSTRACT

A mechanism is provided for throwing several toggle switches together, especially toggle contact breakers, which are enclosed in an explosion proof container. A link between the toggles distributes manual toggling force over all of them from a single manual throw switch. The single manual throw switch may be located outside the explosion proof container and be connected to the link to the toggles through a wall, e.g., a moveable wall such as a door. In one practical embodiment, the link is an elongate tie bar for the toggles, and the manual throw switch is connected to the spaced apart forks which are geared together.

25 Claims, 5 Drawing Sheets

OPERATING MECHANISM FOR THROWING TOGGLE SWITCHES

BACKGROUND OF THE INVENTION

1. Field of the Invention

This invention relates to operating mechanisms for throwing multiple toggles in synchronism with one another.

2. Background of the Invention

It is frequently necessary in electrical installations that a number of toggle moulded case circuit breakers be toggled in synchronism with one another. One method of achieving this is by means of a tie bar acting on all the circuit breakers together. When such a tie bar is manually moved to toggle the circuit breakers it is, at least sometimes, the case that considerable force must be exerted on one section of the tie bar resulting in torque on the tie bar and inefficient use of force.

Any problems encountered in such mechanisms may be accentuated because the toggle circuit breakers involved are frequently heavy to operate and the combined force need for multiple circuit breakers may be quite great even when torque is not a relevant factor.

One or an arrangement of circuit breakers is frequently encountered within closed enclosures such as explosion proof enclosures, see, for example, U.S. Pat. No. 2,213,657 issued to Rowe on Oct. 12th, 1938 and describing the operation of one circuit breaker from outside an enclosure. The circuit breakers themselves may be arranged within the enclosure with the tie bar and are operated by leverage from a single manually operated handle projecting out of the enclosure. The arrangement and operation of electrical circuit breakers within explosion proof enclosures are governed by regulations in many countries. The regulations may differ from country to country but generally impose restrictions on the mechanism with a view towards safety.

In such systems, additional problems arise in that it is sometimes necessary to actually access the interior of the enclosure, after which a realignment of the operating mechanism of the circuit breakers may be difficult. When such an enclosure surrounds the circuit breakers, it is usually provided with a door and the operating mechanism for the circuit breakers may be located in the door. The door may be hinged onto the enclosure and, if it is opened for any reason, projecting parts of the operating mechanism for the circuit breakers may push the circuit breakers and toggle them during the closing arc of the door. Even if the circuit breakers are not toggled during closing movement of the door, it may be difficult to properly align the operating mechanism with the circuit breakers.

The problem of realignment after accessing the enclosure is so acute that in some instances arrangements have been made to access the circuit breakers through a back wall of the enclosure on which the circuit breakers themselves are located to avoid disturbance of the alignment of the operating system. Sometimes push button operating system which utilizes cams to move the circuit breakers maybe used but these systems also suffer from problems of realignment after opening the enclosure.

SUMMARY OF THE INVENTION

An attempt has now been made to provide an operating mechanism for synchronously toggling a bank of toggles, such as electrical toggle circuit breakers. Moreover, the problems arising in the toggling of such circuit breakers through a tie bar within an enclosure, such as an explosion proof enclosure, have been considered and an attempt has been made to alleviate any problem in assembling or reassembling the total system after the interior of the enclosure has been accessed.

According to the invention there is provided a mechanism for operating a plurality of toggles synchronously through a tie bar for the toggles, comprises a mechanism for operating a plurality of toggles synchronously through a tie bar for the toggles, comprising means to transmit manual force from a remote location to the tie bar for toggling, and distributor means to distribute said manual force laterally (over the length of the tie bar).

Such apparatus may comprise at least first and second two-pronged forks each adapted to engage the tie bar at spaced apart locations, the forks being cooperatively movable between at least first and second respective fork positions to move the tie bar laterally between corresponding first and second tie bar positions, whereby the toggles are toggled by lateral movement of the tie bar between its first and second positions manually operable means to move one fork, gear means associated with said on fork to gear the other fork to move synchronously with said one fork. Suitably, to accommodate "ON" and "OFF" and "RESET" positions of the circuit breakers, the tie bar is movable between a first "OFF" position, a second "ON" position, and a third intermediate "RESET" position.

In one practical embodiment the first fork may be mounted on a drive shaft to extend therefrom in parallel offset relation, the drive shaft being rotational at least through an angle to move the first fork between its first and second positions. A manually operable handle may be provided at one end of the shaft for rotating it. The parallel offset relation of each fork may be provided by cranking each fork to its respective shaft through crank arm extending substantially at 90° to the fork and the respective shaft.

The gear means may comprise a drive gear wheel mounted on the drive shaft meshing with a driven gear wheel mounted on a driven shaft upon which the second fork is mounted to extend therefrom in a parallel offset relation, the gear ratio being 1:1. Thus when the handle is turned to move the forks and hence the tie bar, manual force transmitted to the handle may be distributed through the gearing to be transmitted to both forks. It will of course be apparent that more than two forks may be present.

Stop means may be provided to inhibit relative axial movement of the drive gear wheel and the driven gear wheel. Thus the stop means may act to retain the gear wheels in engagement irrespective of any force tending to move only one of the shafts axially, any such force being distributed to both shafts.

The stop means may comprise a spacer mounted on one of the drive shaft and the driven shaft between the respective gear wheel and crank arm. The spacer projects between the gear wheel and the crank arm of the other of the drive shaft and the driven shaft, so as to make the shafts fast one with the other so that they may be moved in their axial directions as a unit.

Distal ends of prongs each fork may be contoured to facilitate engagement with the tie bar, for example the ends may be rounded, bevelled or even slightly spread apart.

The invention also includes electrical switching mechanism comprising a row of toggle circuit breakers united by a common tie bar and a mechanism for operating the toggles as above described. The shafts of the operating system may conveniently be rotatable in sleeves which are set into the thickness of the door.

The toggle circuit breakers may be mounted on a rear wall of an enclosure and the mechanism for operating the toggles may be mounted on a door of the enclosure which is opposed to the rear wall. The operating mechanism may extend through the door so that the handle projects to the outside.

BRIEF DESCRIPTION OF THE DRAWINGS

A embodiment of the invention will now be described by way of example with reference to the drawings and which.

DETAILED DESCRIPTION OF A PREFERRED EMBODIMENT

The drawings illustrate a three pole circuit breaker with a common tie set in an enclosure 10 having a door 12. The enclosure 10 may be an explosion proof enclosure and may be possibly set in the thickness of a wall. In this case the distance between the front wall of the enclosure which comprises door 12 and the rear wall which carries the circuit breakers may be substantially the same as the wall thickness or, at least, vary not very greatly from such thickness.

Figure 5:
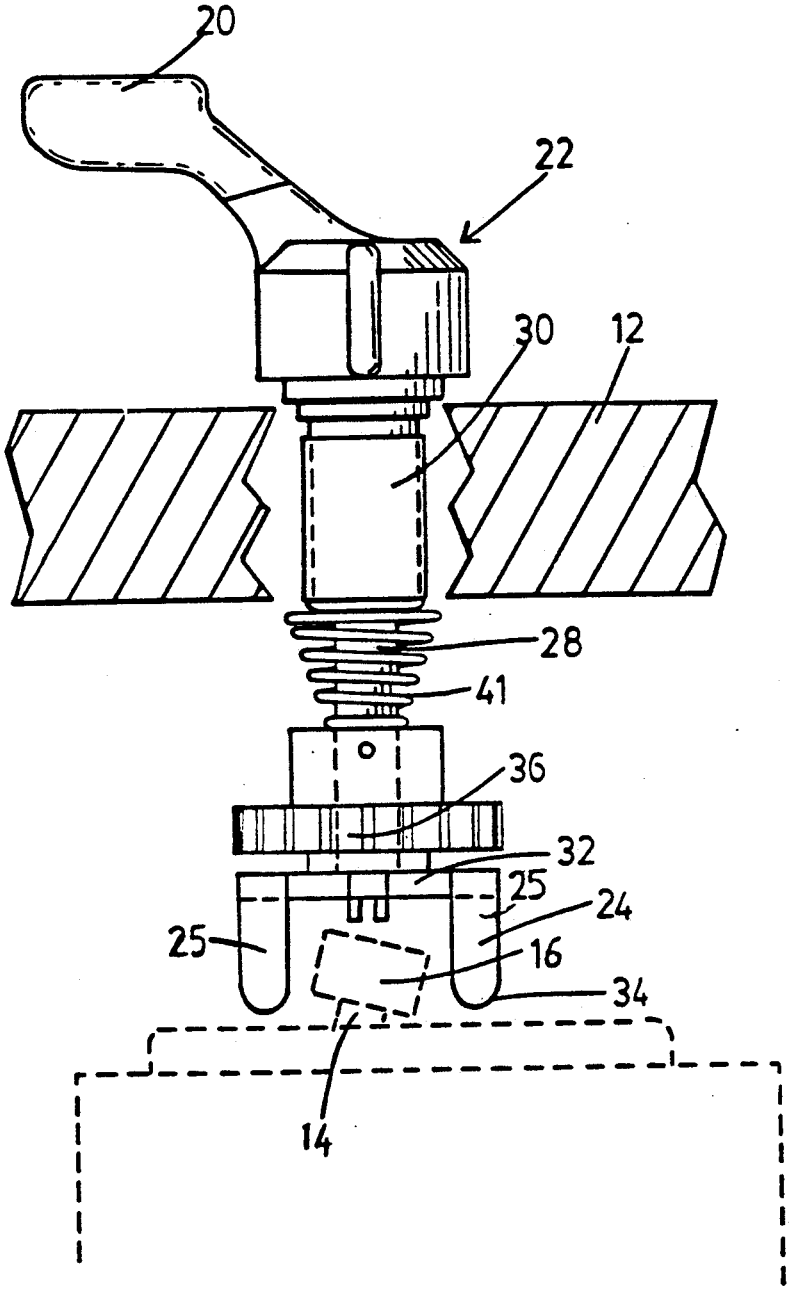
FIG. 5 is a similar end view to that of FIG. 4 with the switches toggled into a different position.
Figure 6:
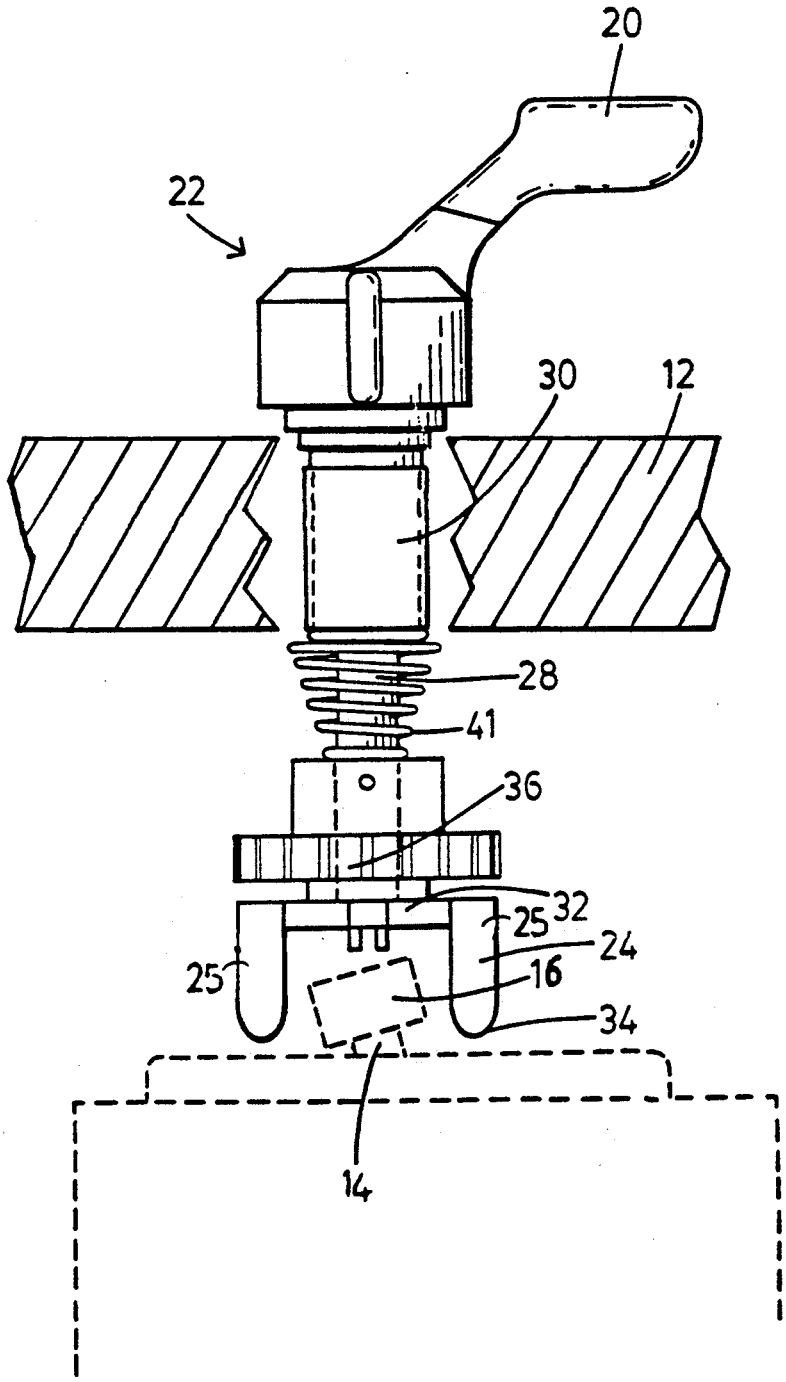
FIG. 6 is a similar view of the operating mechanism of FIG. 4 with the switches toggled into yet another position.

The circuit breakers may comprise three toggle circuit breakers 14 which are united for common operation by a tie bar 16. Although the circuit breakers 14 may be toggled between only two positions, i.e. an "ON" position and an "OFF" position as shown in FIGS. 5 and 6 respectively, it is a conventional that the switches also have a "RESET" position intermediate the "ON" positions and "OFF" positions. The operating mechanism is shown in the "RESET" position in FIG. 4.

The toggle circuit breakers 14 and the tie bar 16 may be located on the rear wall 18 of enclosure 10 to be operable by means of handle 20 of operating mechanism 22 for throwing the circuit breakers, which operating mechanism 22 is set through the thickness of the door 12 with the handle 20 projecting to the outside of the door. Since the enclosure 10 may be an explosion proof enclosure, the thickness of the door may be appreciable.

Figure 1:
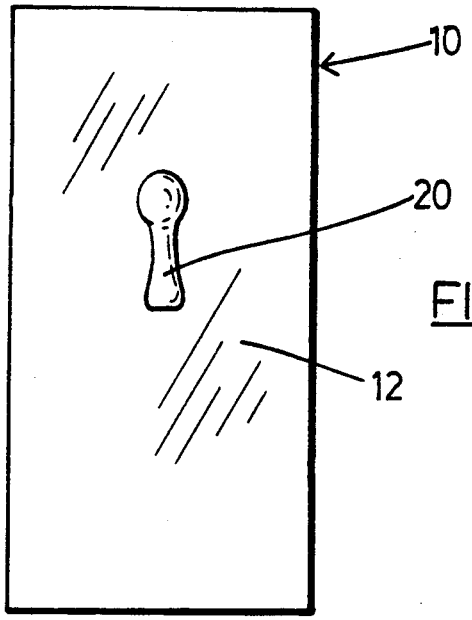
FIG. 1 is a very general view of an enclosure having a hinged door and housing switches which have to be operated from outside the closed door, the door being shown in the closed position.
Figure 2:
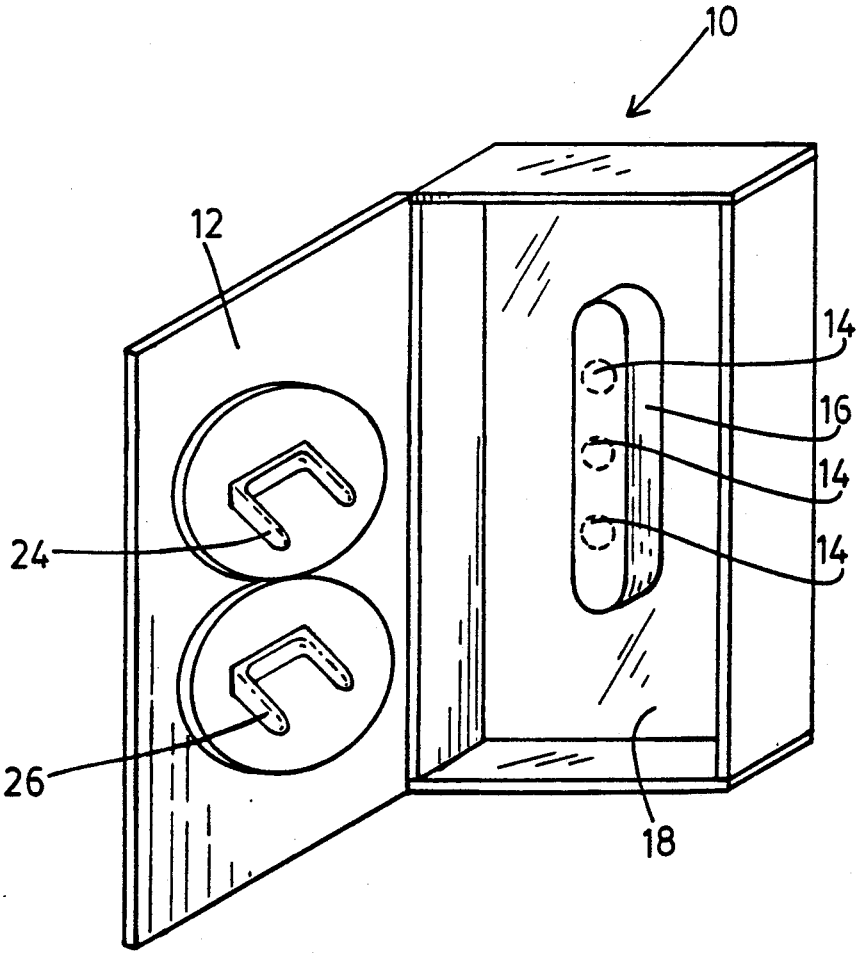
FIG. 2 is a similar view of the enclosure of FIG. 1 but with the door in the open position.
Figure 3:
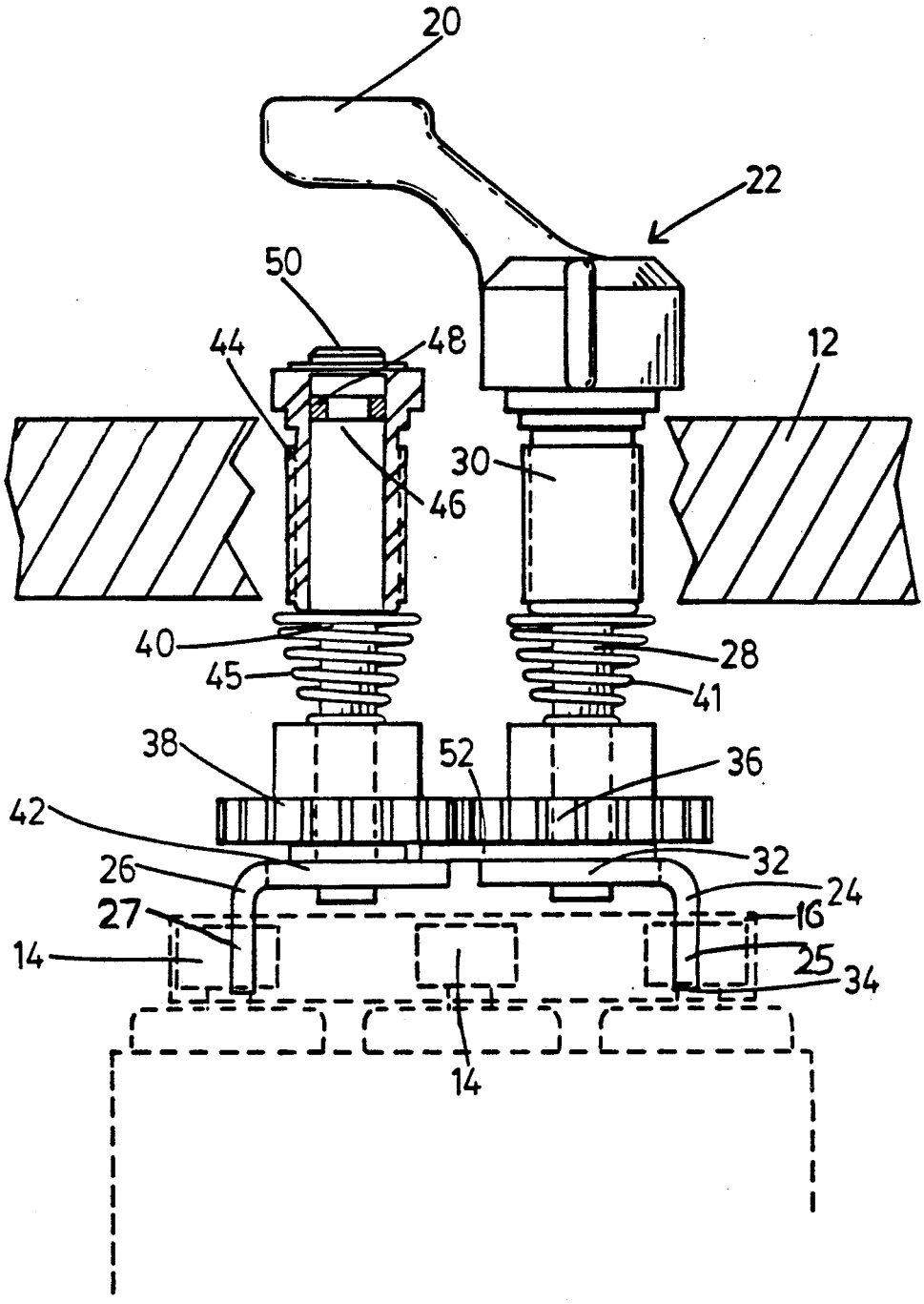
FIG. 3 as a side view of one embodiment of the operating mechanism of the invention partly in section with the door of the enclosure broken away.

The operating mechanism 22 acts on tie bar 16 through spaced apart forks 24, 26. The forks 24, 26 are spaced apart along the length of the tie bar 16 to act symmetrically on it. Two forks are shown but it is to be appreciated that three or more forks might be used. The forks 24, 26 engage with the tie bar 16 only when the door 12 of the enclosure 10 is shut. When the door 12 is open as shown in FIG. 1 the whole of the operating mechanism 22 swings away from the tie bar 16 with the door.

The handle 20 of the operating mechanism 22 is located at one end of a first driving shaft 28 which passes through the thickness of the door 12 within a sleeve 30 in which it is rotatable. At the end of driving shaft 28 which is remote from the handle 20, i.e. within the enclosure 10, fork 24 is mounted to extend further into the enclosure. The axis of fork 24 is parallel with that of shaft 28 so that the axes of fork 24 and shaft 28 are in parallel offset relation and the fork 24 extends inwardly beyond the end of shaft 28.

The fork 24 comprises two prongs 25 which, when door 12 is closed, engage the tie bar 16 to either side of it. A crank arm 32 of fork 24 connects the fork to the shaft 28. The crank arm 32 is substantially at right angles to the axis of the fork 24. The ends 34 of the prongs 25, of the fork 24 may be contoured for easy engagement of the fork with the tie bar during closing of the door 12. Thus, as illustrated, the ends 34 of the prongs 25, of the fork are rounded but they may be alternatively bevelled or even spread outwardly to widen the space between them at the entrance point so that any slight misalignment of the fork with the tie bar during closing of the door may tend to be self-correcting.

The shaft 28 projects from door 12 toward the inside of the enclosure 10 to the extent necessary for forks 24, 26 to engage the tie bar between their prongs 25 and 27. On the projecting part of the shaft 28, a gear wheel 36 is mounted coaxially to rotate with it. The gear wheel 36 is biased toward the crank arm 32 of the fork 24 by means of a cone spring 41. The cone spring 41 allows the inward projection of the shaft, and hence the fork 24, to be minimal while retaining spring bias of the gear wheel 36 towards the fork 24. This feature is of importance when the depth of the enclosure is very shallow but, in principle, there is no reason why another form of spring, for example a helical spring, may not be used.

The gear wheel 36 is rotated when drive shaft 28 is rotated by manual operation of the handle 20. It meshes with a second gear wheel 38 which is driven by it on a freely rotatable driven shaft 40 which carries second fork 26 having prongs 27. Fork 26 is carried on driven shaft 40 in a similar manner as that described for fork 24 carried on drive shaft 28. The details of construction of fork 26 are also similar to those of fork 24. There is no reason, in principle, why forks 24 and 26 should not be of different constructions but the lengths of the crank arm 32 of fork 24 and the length of a crank arm 42 of fork 26 must be the same when gear wheels 36 and 38 are of the same diameter. In general, provided that rotation of gear wheel 36 through shaft 28 and handle 20 acts to rotate gear wheel 38 such that each of the forks 24, 26 acts at separate longitudinally space apart locations of tie bar 16 to provide similar lateral force on the tie bar over the same distance, the details of construction of the gear wheels and forks and their proportions are a matter of choice. It is, however, convenient that the gear wheels be of the same diameter and the forks and their crank arms be similar.

Shaft 40 is driven by means of gear wheels 36, 38 to rotate in sleeve 44. A cone spring 45 biases the gear wheel 38 towards the crank arm 42 in a similar manner to that described in relation to cone spring 41.

Since driven shaft 40 is driven by means of driving force provided from drive shaft 28, no handle is provided for shaft 40. The stub end 46 of shaft 40 need not project from the thickness of the door 12 but may be arranged to rotate on a elastomeric bearing 48. Sleeve 44 may be fixed in position in the thickness of the door 12 by any convenient means, for example by threading 44 onto 12. Same can be applied to 30 and 12.

The operating mechanism may be summarized as comprising a first sub-assembly which includes the handle 20, the drive shaft 28, the sleeve 30, the fork 24 with its crank arm 32, the gear wheel 36 and the cone spring 41; and a second sub-assembly which includes the shaft 40, the sleeve 44, the gear wheel 38, fork 26 with its crank arm 42, and cone spring 45. The first and second sub-assemblies may be latched together so that any axial movement of either shaft will be transmitted to the other shaft also. Thus the gear wheels 36, 38 will be maintained in engagement even if one of the shafts 28, 40 moves axially. Moreover, latching the sub-assemblies together allows the manipulation of the sub-assemblies as a unit in either axial direction of the shafts 28, 40. The latching means may be of any convenient form but, as illustrated, comprises a spacer 52 located on the drive shaft 28 between the gear wheel 36 and the crank arm 32. The spacer 52 extends towards the shaft 40 beyond the outer perimeter of the gear wheel 36. Thus, spacer 52 extends under gear wheel 38 as well as under gear wheel 36. It also extends over crank arm 32 and over crank arm 42. A small spacer of similar thickness may be inserted between gear wheel 38 and crank 42 to provide stability to the combination. It will be seen that relative axial movement between the shafts 28, 40 is prevented in one direction by abutment of spacer 52 against crank arms 32, 42, and in the other direction by abutment of a spacer 52 against gear wheels 36, 38.

In operation, when it is desired to move the toggle circuit breakers 14 from an "OFF" position as shown in FIG. 5 into an "ON" position as shown in FIG. 6, the procedure is as follows. Handle 20 is moved anti-clockwise from the position shown in FIG. 4 to the position shown in FIG. 5. This causes anti-clockwise rotation of shaft 28 and gear wheel 36 and crank arm 32 of fork 24. Fork 24 itself moves through an arc, a linear component of which movement tends to move the tie bar 16 sideways. The anti-clockwise rotation of gear wheel 36 causes clockwise rotation of gear wheel 38 and corresponding arcuate movement of fork 26. The arcuate movement of fork 26 has a linear component of the same size and in the same direction as that of fork 24. The action of both forks is, therefore, to move tie bar 16 sideways into the position shown in FIG. 6. It can be seen from FIG. 6 that the sideways movement of tie bar 16 has toggled the switches 14.

In order to toggle the switches into an "OFF" Position, the handle is turned the same direction in the opposite direction thereby reversing the movement of the tie bar 16.

Figure 4:
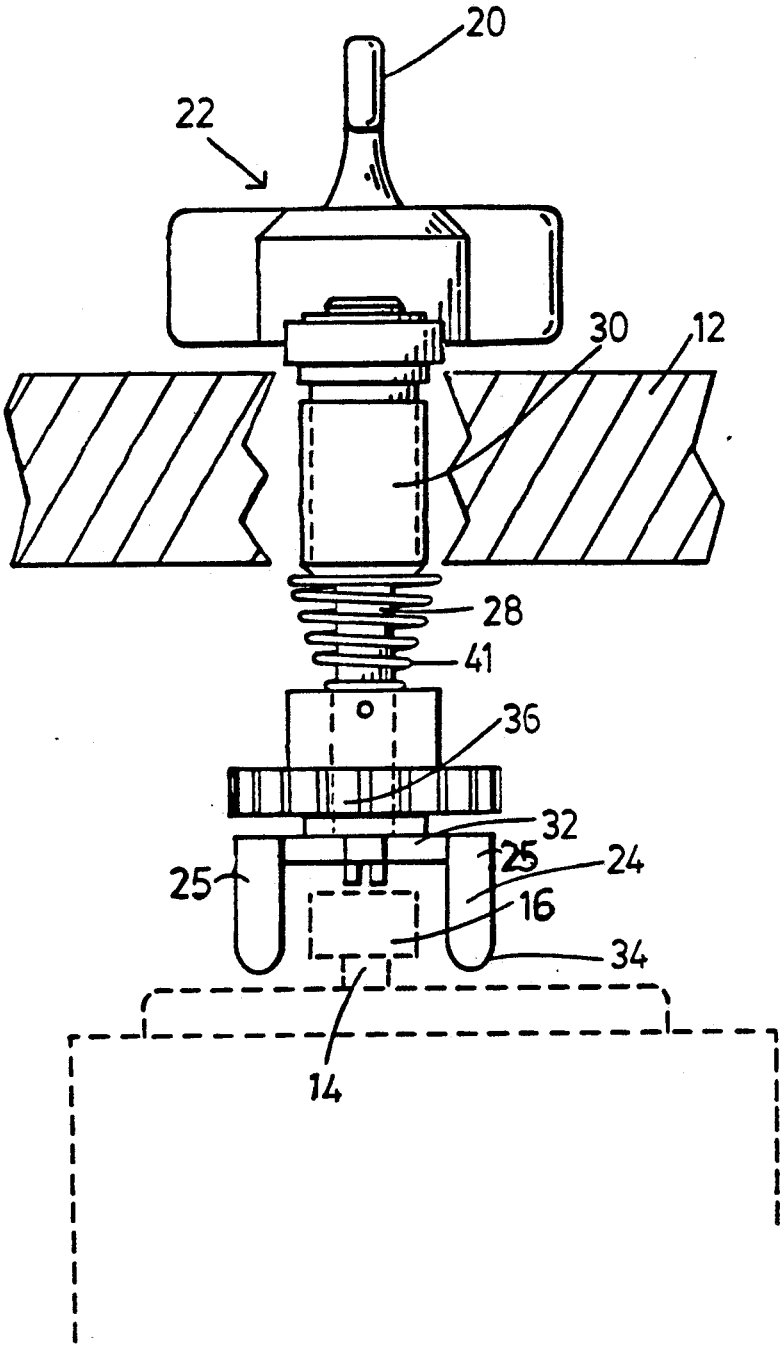
FIG. 4 is an end view of the operating mechanism of FIG. 3, again with the door of the enclosure broken away.

In order to toggle breakers 14 for "Reset" Positive as in FIG. 4 to "ON". The breakers 14 is first toggled to "OFF" as in FIG. 5 and then toggled to "ON" as in FIG. 6.

In order to access the enclosure, maintenance of the switches, or of the operating mechanism, the door 12 of the enclosure may be opened. On reclosing the door, the spreading the mouth between the prongs of forks 24 and 26 either by rounding of the prong ends 34, as shown, or by other means, tends to trap the tie bar 16 even if the toggle position of 14 has been changed from "ON" to OFF" or vice versa.

The operation of multi-pole breakers with a common tie bar has frequently required a level of mechanical force which may not be desirable especially when the breakers are of high current ratings or there are a multiplicity of them. It has been found, when testing one embodiment of the present invention in operation with a three-pole breaker, that the use of paired shafts with cooperating gears driven through manual operation of one of the shafts may significantly reduce a total operating force required This is believed to be due to the fact that the forks act to distribute force on spaced apart locations of the tie bar.

It is envisaged that embodiments of the invention may usefully comprise only two shafts and associated gears and forks. However, the invention is not so limited. It is clear that a plurality of gear wheels with associated forks may be utilized and, if a large number of toggles where involved such that a very long tie bar were necessary, the use of more than two gear wheels and associated forks might be useful.

We claim:

1. An electrical switch comprising:

at least two toggle circuit breakers at spaced apart locations and united by a common tie bar; and a mechanism for operating the toggle circuit breakers, and wherein the mechanism comprises:

first and second forks each adapted to engage the tie bar, the forks being cooperatively movable between at least first and second respective fork positions to move the tie bar laterally between corresponding at least first and second tie bar positions, whereby the at least two toggle circuit breakers are toggled by lateral movement of the tie bar between its at least first and second positions;

manually operable means to move the first fork; and gear means associated with said first fork to gear the second fork to move synchronously with said first fork.

2. The switch as claimed in claim 1 in which the forks are cooperatively movable between first, second and intermediate positions to move the tie bar laterally between "ON", "OFF" and "RESET" positions.

3. The switch as claimed in claim 1 in which each fork has two prongs, and distal ends of the prongs of each fork are contoured to facilitate engagement of the fork with the tie bar.

4. The switch as claimed in claim 3 in which the ends of the prongs of each fork are rounded.

5. The switch as claimed in claim 3 further comprising an enclosure, the enclosure comprising a closed compartment having a rear wall on which the toggle circuit breakers are mounted and a front wall opposed to the rear wall and comprising a door on which the drive shaft and driven shaft are mounted, the sleeves of the drive and driven shaft being mounted in a thickness of the door, and a handle being located on an outer surface of the door.

6. The switch as claimed in claim 1 further comprising an enclosure, the enclosure comprising a closed compartment having a rear wall on which the toggle circuit breakers are mounted and a front wall opposed to the rear wall and comprising a door on which the drive shaft and driven shaft are mounted.

7. The switch as claimed in claim 1 further comprising, a drive shaft on which the first fork is mounted to extend therefrom in parallel offset relation thereto and wherein, the drive shaft may be rotated to move the first fork between the first and second first fork positions.

8. The switch as claimed in claim 7 in which the drive shaft is provided with a manually operable handle.

9. The switch of claim 7 further comprising:

a driven shaft on which the second fork is mounted, the driven shaft extending from the fork in parallel offset relation thereto;

a drive gear wheel mounted on the drive shaft;

a driven gear wheel mounted on the driven shaft to mesh with the drive gear wheel such that there is a gear ratio of 1:1 between the drive gear wheel and the driven gear wheel.

10. The switch as claimed in claim 9 in which a link is provided on the drive shaft to transmit any axial movement of the drive shaft in one direction to the driven shaft also.

11. The switch as claimed in claim 10 in which each fork is cranked to its respective shaft through a crank arm extending substantially at 90° to the fork and the respective shaft.

12. The switch as claimed in claim 11 in which the link comprises a spacer mounted on the drive shaft between the drive gear wheel and respective crank arm, the spacer projecting between the driven gear wheel and the crank arm of the driven shaft.

13. The switch as claimed in claim 11 wherein the switch has a mounting panel such as a door, in which a sleeve is provided around each of the drive and driven shafts, each shaft being rotatable in its respective sleeve, each sleeve being adapted for mounting in a thickness of the mounting panel.

14. The switch as claimed in claim 12 further comprising an enclosure, the enclosure comprising a closed compartment having a rear wall on which the toggle circuit breakers are mounted and a front wall opposed to the rear wall and comprising a door on which the drive shaft and driven shaft are mounted, the sleeves of the drive and driven shafts being mounted in a thickness of the door, and a handle being located on an outer surface of the door.

15. A switching mechanism for use with a plurality of toggles connected by a tie bar for simultaneous movement between first and second positions by lateral movement of the tie bar, the switching mechanism comprising:

first and second forks at spaced apart locations, each for engagement of the tie bar as it moves between the first and second tie bar positions;

manually operable means to move the first fork; and gear means operably connecting the forks for synchronous movement between first and second postions of each fork, first and second fork positions corresponding to the first and second tie bar positions.

16. The switching mechanism as claimed in claim 15 wherein, the forks are each movable between the first and second fork positions and a third position intermediate thereof, for movement of the tie bar between a third position corresponding to the third fork position.

17. The switching mechanism as claimed in claim 16 further comprising, a drive shaft on which the first fork is mounted to extend therefrom in parallel offset relation thereto and wherein, the drive shaft may be rotated to move the first fork between the first and second first fork positions.

18. The switching mechanism of claim 17 further comprising:

a driven shaft on which the second fork is mounted, the driven shaft extending from the fork in parallel offset relation thereto;

a drive gear wheel mounted on the shaft;

a driven gear wheel mounted on the driven shaft to mesh with the drive gear wheel such that there is a gear ratio of 1:1 between the drive gear wheel and the driven gear wheel.

19. The switching mechanism as claimed in claim 18 in which a link is provided on the drive shaft to transmit any axial movement of the drive shaft in one direction to the driven shaft also.

20. The switching mechanism as claimed in claim 19 in which each fork is cranked to its respective shaft through a crank arm extending substantially at 90° to the fork and the respective shaft.

21. The switching mechanism as claimed in claim 20 in which the link comprises a spacer mounted on the drive shaft between the drive gear wheel and respective driven crank arm, the spacer projecting between the gear wheel and the crank arm of the driven shaft.

22. The switching mechanism as claimed in claim 20 for use with a circuit breaker having a mounting panel such as a door, in which a sleeve is provided around each of the drive and driven shafts, each shaft being rotatable in its respective sleeve, each sleeve being adapted for mounting in a thickness of the mounting panel.

23. The switching mechanism as claimed in claim 17 in which the drive shaft is provided with a manually operable handle.

24. The switching mechanism as claimed in claim 15 in which each fork has two prongs, distal ends of the prongs of each fork being contoured to facilitate engagement of the fork with the tie bar.

25. The switching mechanism as claimed in claim 24 in which the ends of the prongs of each fork are rounded.

* * * * *